United States Patent [19]

Takahashi

[11] Patent Number: 4,887,575

[45] Date of Patent: Dec. 19, 1989

[54] SYSTEM AND METHOD FOR CONTROLLING A MIXTURE RATIO OF AIR-FUEL MIXTURE SUPPLIED TO AN INTERNAL COMBUSTION ENGINE

[75] Inventor: Hiroshi Takahashi, Kanagawa, Japan

[73] Assignee: Nissan Motor Company, Limited, Japan

[21] Appl. No.: 247,292

[22] Filed: Sep. 22, 1988

[30] Foreign Application Priority Data

Sep. 22, 1987 [JP] Japan ..... 62-236298

[51] Int. Cl.[4] ..... F02D 41/14

[52] U.S. Cl. ..... 123/435; 123/489; 123/492; 123/493

[58] Field of Search ..... 123/435, 440, 489, 492, 123/493, 589

[56] References Cited

U.S. PATENT DOCUMENTS

| | | | |
|---|---|---|---|
| 4,417,556 | 11/1983 | Latsch | 123/435 |
| 4,561,401 | 12/1985 | Hata et al. | 123/435 |
| 4,624,229 | 11/1986 | Matekunas | 123/435 |
| 4,690,115 | 9/1987 | Conlogue et al. | 123/366 |
| 4,789,358 | 11/1988 | Kasanami et al. | 123/492 |

FOREIGN PATENT DOCUMENTS

| | | | |
|---|---|---|---|
| 61-155349 | 3/1986 | Japan . | |
| 63-75326 | 4/1988 | Japan | 123/435 |

*Primary Examiner*—Andrew M. Dolinar

*Attorney, Agent, or Firm*—Lowe, Price, LeBlanc, Becker & Shur

[57] ABSTRACT

A system and method for determining and controlling the mixture ratio of an air-fuel mixture supplied to an internal combustion engine in which the air-fuel mixture ratio is estimated from a maximum internal pressure of an engine cylinder. The estimated air-fuel mixture ratio is then positively ascertained on the basis of a determination result derived by a weighting processing calculation of input signals indicating various engine and vehicle operating conditions affecting the change in the air-fuel mixture ratio using a weight vector with a reference signal. The air-fuel mixture is controlled on the basis of the ascertained air-fuel mixture ratio. Furthermore, each parameter of the weight vector is learned and corrected in a direction toward which a correct percentage of the determination of the rich-side or lean-side air-fuel mixture ratio by the weight calculation is increased.

18 Claims, 6 Drawing Sheets

SYSTEM AND METHOD FOR CONTROLLING A MIXTURE RATIO OF AIR-FUEL MIXTURE SUPPLIED TO AN INTERNAL COMBUSTION ENGINE

BACKGROUND OF THE INVENTION (1) Field of the Invention

The present invention relates to a system and method for controlling the air-fuel mixture ratio of an air-fuel mixture supplied to an internal combustion engine, without using a conventional sensor for directly detecting intake air quantity.

(2) Background of the Art

Generally, an air-fuel mixture ratio of an air-fuel mixture supplied to an engine is controlled in such a way that an intake air quantity is measured by means of one of various kinds of intake quantity measuring means such as a vane-type, hot-wire type, or Kármán vortex type intake air quantity sensors and a quantity of fuel supplied to the engine is determined on the basis of the measured air quantity.

The vane-type intake air quantity sensor is such that a quantity of rotation of a vane rotating in response to an intake air pressure applied thereto is detected by means of a potentiometer so as to measure the intake air quantity.

The hot-wire type intake air quantity sensor is such that a current flowing through a bridge circuit is controlled on the basis of a change in a resistance value of a hot-wire resistor according to the intake air quantity and the controlled current value is used to detect the intake air quantity.

The Kármán vortex intake air quantity sensor is such that a quantity of vortex downstream of a probe thereof is measured to detect the corresponding air quantity.

However, in the air-fuel mixture ratio controlling system in which the air-fuel mixture ratio is controlled on the basis of the detected intake air quantity, one of the above-described intake air quantity detecting means is needed since such intake air quantity detecting means occupies a high percentage of cost with respect to a whole engine cost, the cost of installing such an intake air quantity detecting means on the engine is very high and is less reliable when a low-cost engine is developed or when the highly reliable whole engine controlling system is installed with fewer numbers of parts.

A Japanese Patent Application First Publication Sho 61-55349 published on Mar. 19, 1986, exemplifies one of the air-fuel mixture ratio controlling systems in which an internal cylinder pressure and a load imposed on the engine (fuel injection quantity) are detected and the air-fuel mixture is controlled on the basis of the detected values of the internal cylinder pressure and engine load so as to bring a ratio of internal cylinder pressure to an engine load into an ideal value. In the air-fuel mixture ratio controlling system disclosed in the above-identified Japanese Patent Application Publication, the intake air quantity detecting means can be omitted.

However, it is difficult to estimate the air-fuel mixture only on the basis of the internal cylinder pressure since, as a matter of fact, a waveform of the internal cylinder pressure is complicated varied.

Therefore, the accuracy of controlling the air-fuel mixture ratio cannot be improved further.

SUMMARY OF THE INVENTION

It is, therefore, an object of the present invention to provide a system and method for controlling the air-fuel mixture ratio for an internal combustion engine having a high accuracy in controlling the air-fuel mixture ratio.

It is another object of the present invention to provide an inexpensive and highly reliable system and method for controlling the air-fuel mixture ratio for an internal combustion engine which has no intake air quantity detecting means.

The above-described objects can be achieved by providing a system for determining and controlling the mixture ratio of air-fuel mixture supplied to an internal combustion engine, comprising: (a) first means for detecting an internal pressure of an engine cylinder; (b) second means for deriving a maximum value of the internal cylinder pressure detected by the first means for each combustion stroke of the engine cylinder and for estimating rich-side air-fuel mixture ratio and lean-side air-fuel mixture ratio from the derived maximum value of the internal cylinder pressure; (c) third means for detecting various operating conditions of the engine and a vehicle in which the engine is mounted affecting a change in the air-fuel mixture except the first means and outputting first signals indicative of the individual operating conditions; (d) fourth means for processing a weighting calculation for the first signals using a weight vector and outputting a second signal indicative of the result of weighting calculation, the second signal being used to determine the rich or lean air-fuel mixture ratio; (e) fifth means for comparing the level of the second signal with a reference signal level so as to determine whether the air-fuel mixture ratio deviates from the rich-side or lean-side with respect to a target air-fuel mixture ratio; (f) sixth means for ascertaining the air-fuel mixture ratio from the rich-side or lean-side air fuel mixture ratio estimated by the second means on the basis of the determination result by the fifth means; (g) seventh means for controlling the mixture ratio of the air-fuel mixture supplied to the engine on the basis of the air-fuel mixture ratio ascertained by the sixth means; (h) eighth means for determining the correctness or incorrectness of the determination result by the fifth means according to the air-fuel mixture controlled by the seventh means; and (i) ninth means for correcting the weight vector in the fourth means on the basis of the result of determination by the seventh means in a direction toward which a percentage of the correct determination is increased.

The above-described objects can also be achieved by providing a method for determining and controlling a mixture ratio of the air-fuel mixture supplied to an internal combustion engine, comprising the steps of: (a) detecting an internal pressure of an engine cylinder; (b) second means for deriving a maximum value of the internal cylinder pressure detected in the step (a) for each combustion stroke of the engine cylinder and estimating rich-side air-fuel mixture ratio and lean-side air-fuel mixture ratio from the derived maximum value of the internal cylinder pressure; (c) detecting various operating conditions of the engine and a vehicle in which the engine is mounted affecting a change in the air-fuel mixture ratio except that detected in step (a) and outputting the first signals indicative of the individual operating conditions; (d) calculating a weighting processing for the first signals using a weight vector and outputting a second signal indicative of the result of the weighting processing calculation, the second signal being used to determine the rich or lean side air-fuel mixture ratio; (e) comparing the level of the second signal with a reference signal level so as to determine whether the air-fuel mixture ratio deviates from the rich-side or lean-side with respect to a target fuel mixture ratio; (f) ascertaining the air-fuel mixture ratio from either the rich-side or lean-side air-fuel mixture ratio estimated in the step (b) on the basis of the determination result in the step (e); (g) controlling the mixture ratio of the air-fuel mixture supplied to the engine on the basis of the mixture ratio ascertained in step (f); (h) determining the correctness or incorrectness of the determination result of step (e) according to the air-fuel mixture ratio controlled in step (g); and (i) correcting the weight vector used in step (d) on the basis of the result of determination in step (h) in a direction toward which a percentage of the correct determination in step (e) is increased.

DETAILED DESCRIPTION OF THE PREFERRED EMBODIMENT

Reference will hereinafter be made to the drawings in order to facilitate an understanding of the present invention.

Figure 1:
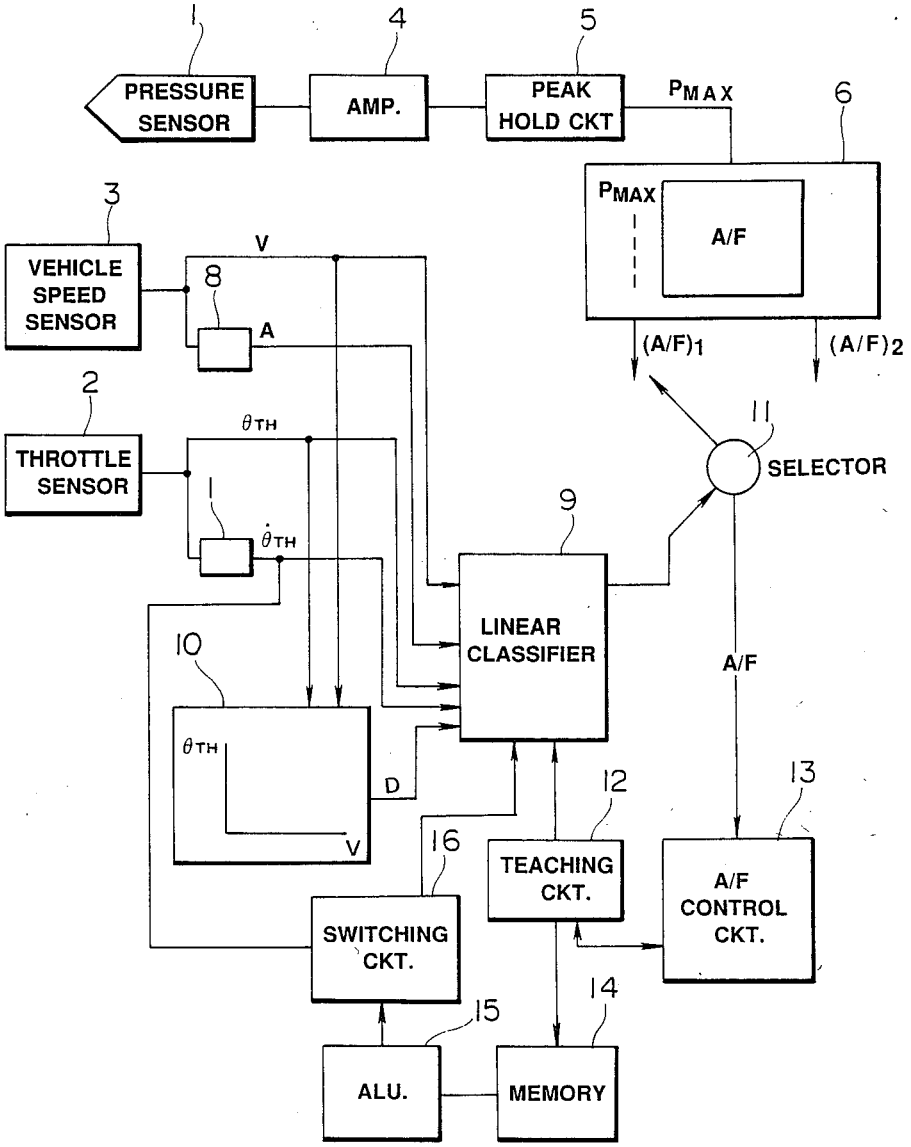
FIG. 1 is the schematic block diagram of a system for controlling a mixture ratio of air-fuel mixture supplied to an internal combustion engine of a preferred embodiment according to the present invention.

FIG. 1 shows the overall configuration of the preferred embodiment of a system for controlling the mixture ratio of an air-fuel mixture supplied to the internal combustion engine.

An internal cylinder pressure sensor 1 is installed on a part of a predetermined cylinder block in the vicinity of a combustion chamber of an engine (not shown). The structure of the internal cylinder pressure sensor 1 is exemplified by a U.S. Pat. No. 4,640,249, the disclosure of which is hereby incorporated by reference. An output signal of the internal cylinder pressure sensor 1 is inputted to an amplifier 4 for providing the amplification and shaping of the internal cylinder pressure signal and then supplied to a peak-hold circuit 5. Thereafter, a maximum value $P_{max1}$ derived from the peak-hold circuit 5 is supplied to an air-fuel mixture ratio estimating circuit 6. It is noted that a crank angle $\theta_{max}$ providing a maximum value of the $P_{max}$ is controlled to become an MBT (Minimum Spark Angle For Best Torque) (Optimum Ignition Timing) for an ignition timing control. The detailed explanation thereof is omitted here.

Figure 4:
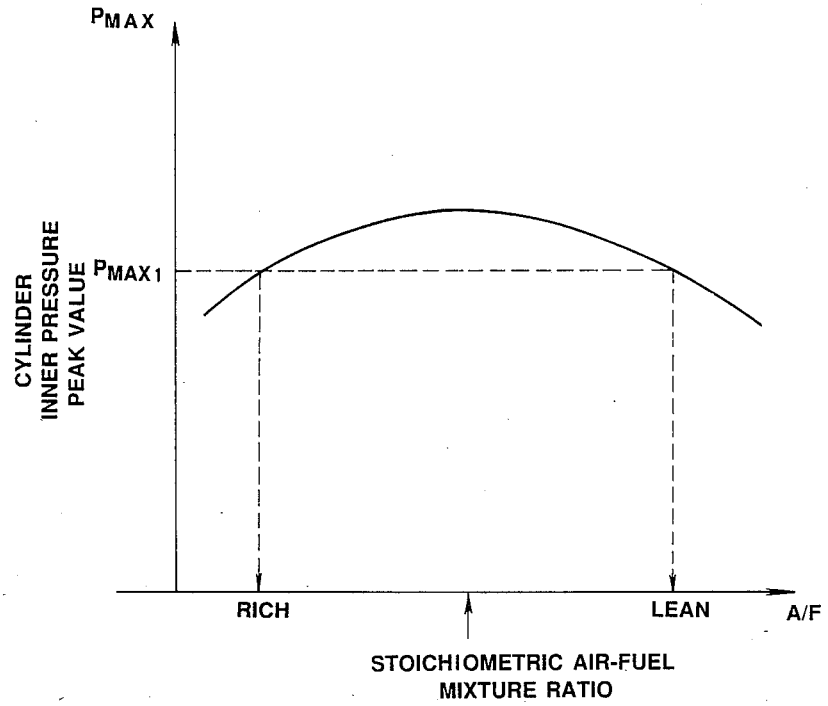
FIG. 4 is a characteristic graph of an internal cylinder pressure value versus an air-fuel mixture ratio supplied to the engine.

The air-fuel mixture ratio estimating circuit 6 stores a relationship between a maximum value $P_{max1}$ and air-fuel mixture ratio A/F shown in FIG. 4 as a map table.

It is noted that the air-fuel mixture ratio A/F providing the maximum value $P_{max1}$ is derived as either a lean side or rich side with respect to a target air-fuel mixture ratio (in FIG. 4, a stoichiometric air-fuel mixture ratio), as shown in FIG. 4. That is to say, the present air-fuel mixture ratio can be estimated as either one of the rich side or lean side. The air-fuel mixture ratio estimating circuit 6 outputs the lean side air-fuel mixture ratio $(A/F)_1$ and rich side air-fuel mixture ratio $(A/F)_2$ retrieved from the map table for the inputted maximum data value $P_{max1}$.

On the other hand, a throttle valve opening angle sensor 2 detects an opening angle $\theta_{TH}$ of an engine throttle valve and outputs a signal indicative thereof. An arithmetic operation circuit 7 calculates a first-order difference $\dot{\theta}_{TH}$ of the throttle opening angle $\theta_{TH}$ derived by the throttle opening angle sensor 2.

A vehicle speed sensor 3 detects a vehicle speed and outputs a signal V indicative thereof. An arithmetic operation circuit 8 calculates a first order difference A of the vehicle speed. These signals $\dot{\theta}_{TH}$, $\theta_{TH}$, V, and A are supplied to a linear classifier 9.

In addition, the throttle valve opening angle $\theta_{TH}$ and vehicle speed signal V are supplied to a running resistance arithmetic operation circuit 10. The running resistance arithmetic operation circuit 10 receives these signals and outputs a running resistance signal D retrieved from a three-dimensional map table for these input values to the linear classifier 9.

The linear classifier 9 carries out a weighting processing of the detected results of various operating conditions by means of a weight vector so that a rich-or-lean determination of an air-fuel mixture ratio with respect to the target air-fuel mixture ratio, outputs a determination signal to a selector 11, and corrects and learns parameters of the weight vector on the basis of a teaching signal supplied from a teaching circuit 12 as will be described later.

In the preferred embodiment, the selector 11 selects either the lean-side air fuel mixture ratio or rich-side air fuel mixture ratio value depending on the determination signal derived from the linear classifier 9.

The selected estimated air-fuel mixture ratio by the selector 11 is supplied to an air-fuel mixture ratio controlling circuit 13.

The air-fuel mixture ratio controlling circuit 13 controls a fuel injection quantity so that the air-fuel mixture becomes the target air-fuel mixture ratio on the basis of the data of the air-fuel mixture ratio selected by the selector 11. Specifically, since the air-fuel mixture ratio derived with respect to the fuel injection quantity before one control period is used to derive the intake air quantity, a new fuel injection quantity is controlled so as to achieve the target air-fuel mixture ratio.

The teaching circuit 12 detects with a high accuracy whether the air-fuel mixture ratio thus controlled is actually rich or lean with respect to the stoichiometric air-fuel mixture ratio and outputs the teaching signal to the linear classifier 9 in such a way that when the detected result of the air-fuel mixture ratio coincides with the determination result of the linear classifier 9, the determination result of the linear classifier 9 is correct and when the detected result of the air-fuel mixture ratio does not coincide with the determination result of the linear classifier 9, it is not correct.

Figure 3:
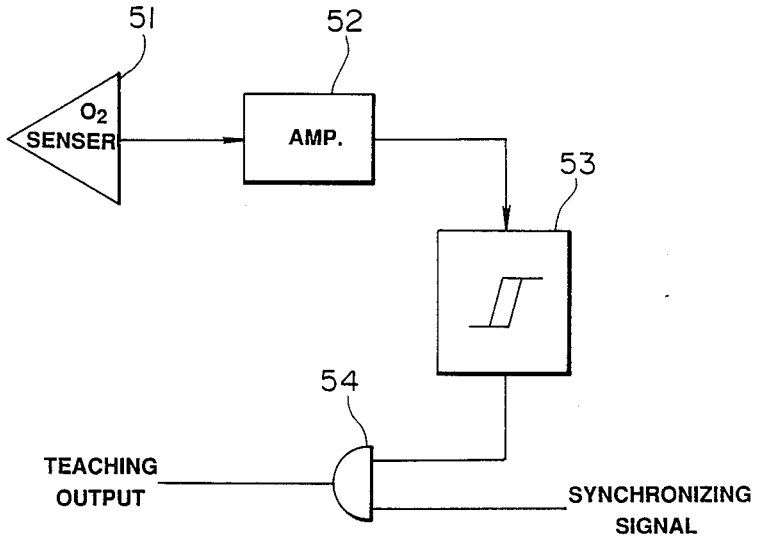
FIG. 3 is a schematic circuit block diagram of a teaching circuit of the system shown in FIG. 1.

FIG. 3 shows a specific example of the teaching circuit 12.

As shown in FIG. 3, an $O_2$ sensor 51 detects the air-fuel mixture ratio from a concentration of oxygen in the exhaust gas. When the air-fuel mixture is rich with respect to the stoichiometric air-fuel mixture ratio, the $O_2$ sensor 51 outputs a high voltage signal. When the air-fuel mixture ratio is lean with respect to the stoichiometric ratio, the $O_2$ sensor 51 outputs a low voltage signal. The signal is amplified by means of an amplifier 52, clearly discriminated as an H (high) level signal or L (low) level signal depending on the rich or lean side of the voltage signal by means of a two-value (binary) element 53 and supplied to one input end of an AND circuit 54.

The other input end of the AND circuit 54 receives a synchronizing signal from the linear classifier 9.

The linear classifier 9 corrects and learns the parameters of the weight vector on the basis of the teaching signal. In a case where the rich-or-lean ratio determination is carried out using the weight vector, it is unreasonable to determine the air-fuel mixture ratio using the single weight vector at times of abrupt accelerations, abrupt decelerations, and steady-state running. Therefore, a memory 14 is provided for storing the correct detection results of the air-fuel mixture ratio (rich or lean) in a time series mode.

For example, a history of the rich or lean air-fuel mixture determinations in the teaching circuit 12, e.g., per past ten control periods, is used to analyze whether the air-fuel mixture is changed from the rich to the lean or from the lean to the rich and the weight vector is switched to an abrupt acceleration/deceleration vector or steady-state weight vector depending on the detection result.

Specifically, an arithmetic operation circuit 16 calculates a running average of the rich or lean determination value with respect to time so as to check a change tendency of the air-fuel mixture with respect to time. A weight vector switching circuit 16 receives a signal indicative of the change in the air-fuel mixture ratio $\dot{A/F}$ and signal indicative of the first order difference $\dot{\theta}_{TH}$ of the throttle valve opening angle, compares a value of $A \times \dot{\theta}_{TH} + B \times \dot{A/F}$ set on the basis of the signal indicative of the change state of the air-fuel mixture ratio and change rate of the throttle opening angle with a predetermined value so as to determine whether the present operating condition is in the abrupt acceleration/deceleration state or the steady operating state depending on whether the value is above or below the predetermined value, and switches the weight vector of the linear classifier 9 depending on the result of comparison.

Figure 2:
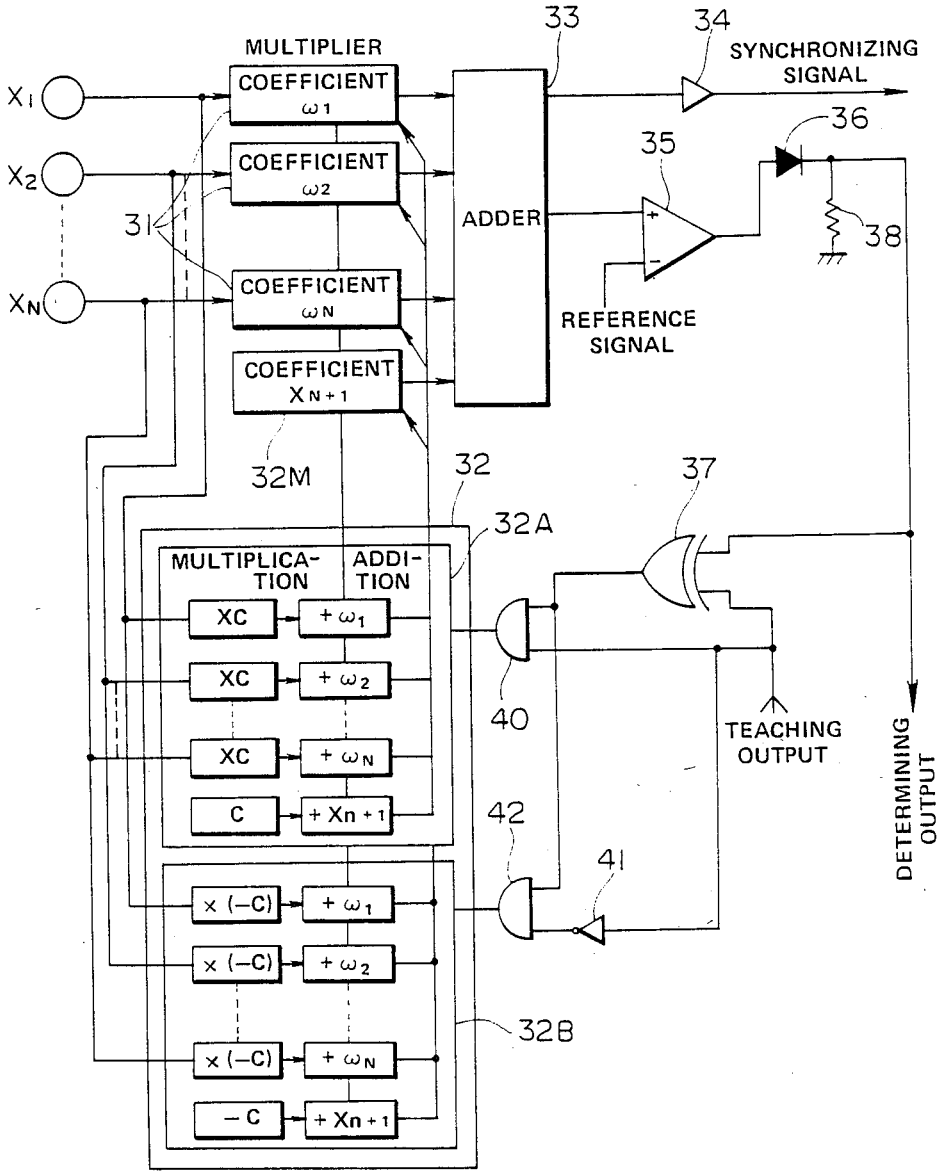
FIG. 2 is a schematic circuit block diagram of a linear classifier of the system shown in FIG. 1.

The linear classifier 9 is constructed as shown in FIG. 2. The linear classifier 9 includes a plurality of multipliers 31 for multiplying input signals $x_1$ to $x_N$ corresponding to various kinds of engine operating conditions by corresponding parameters $\omega_1$ to $\omega_N$ of the weight vectors and an adder 33 for adding respective values obtained by the respective multipliers 31 to a constant $x_{N+1}$ stored in a constant memory 32M.

Upon completion of the addition, the adder 33 outputs an end signal, the end output signal is supplied to a reset terminal of one input end of an AND circuit 54 in the teaching circuit 12 shown in FIG. 3 as the synchronizing signal after a constant time has elasped via a delay circuit 34.

On the other hand, the arithmetically obtained value from the adder 33 is supplied to a non-inverting input terminal of a comparator 35 as an air-fuel mixture ratio determination signal. The determination signal is compared with a reference signal supplied to an inverting input terminal of the comparator 35. When the level at the comparator 35 is above the reference signal, the output signal of the comparator 35 indicates a high level H representing the rich side (or lean side) air-fuel mixture. If the level of the determination signal is below the reference signal, the output signal of the comparator 35 indicates a low level L representing the lean side (or rich side) air-fuel mixture. The output signal derived from the comparator 35 is supplied to the air-fuel mixture ratio controlling circuit 13 shown in FIG. 1 via a diode 36 and to one input terminal of an Exclusive-OR circuit 37.

The other input terminal of the Exclusive-OR circuit 37 receives the teaching signal from the teaching circuit 12 to be described later.

It is noted that the teaching circuit 12 is installed independently of the air-fuel mixture ratio controlling system shown in FIG. 1 installed in a vehicle.

The teaching circuit 12 detects the air-fuel mixture ratio with high accuracy as described above. When air-fuel mixture ratio is rich, the circuit 12 outputs the high level signal H and outputs the low level signal L when the air-fuel mixture ratio is lean.

The Exclusive-OR circuit 37 outputs the low L level signal when both the air-fuel mixture ratio signal derived from the comparator 35 via the diode 36 and the air-fuel mixture ratio signal derived from the teaching circuit 12 are low levels L. However, the Exclusive-OR circuit 37 outputs the high H level signal when the two kinds of input signal levels are different. This signal is inputted to a weight vector corrector 32 via two AND circuits 39 and 41.

In other words, if the air-fuel mixture ratio determination signal coincides with the detection result of the teaching circuit 12, the Exclusive-OR circuit 37 outputs the low level output L since the determination of the rich or lean is correct. If they do not coincide with each other, the high level signal H from either of the AND circuits 39 and 41 is outputted.

The output signal of the Exclusive-OR circuit 37 is supplied to one input terminal of a first AND circuit 40, the other input terminal of the first AND circuit 40 receiving the output signal of the teaching circuit 12. In addition, the output signal of the teaching circuit 12 is supplied to one input terminal of a second AND circuit 42 via an inverter 41, the other input terminal thereof receiving the output signal of the Exclusive-OR circuit 37.

The output signal of the first AND circuit 40 is supplied to a first arithmetic operation portion 32A of the weight vector corrector 32 as a trigger signal.

The output signal of the second AND circuit 42 is supplied to a second arithmetic operation portion 32B of the weight vector corrector 32 as a trigger signal.

The first arithmetic operation portion 32A carries out the correction and updating of each present parameter $\omega_1$ to $\omega_N$ of the multipliers 31 using addition values of each present parameter $\omega_1$ to $\omega_N$ inputted from respective multipliers 31 to values of the respectively corresponding input signals $x_1$ to $x_N$ multiplied by a predetermined positive constant C when the output signal level of the first AND circuit 40 indicates the high level H, i.e., when the air-fuel mixture ratio determination signal from the comparator 35 indicates lean air-fuel mixture ratio in spite of the indication of the rich side air-fuel mixture in the teaching circuit 12. Furthermore, the constant $x_{N+1}$ stored in the memory 32M is corrected and updated by the addition value of the constant $x_{N+1}$ inputted from the memory 32M and the positive constant C ($x_{N+1}+C \rightarrow > x_{N+1}$).

On the other hand, the second arithmetic operation portion 32B carries out the correction and updating of each parameter $\omega_1$ to $\omega_N$ of the multipliers 31 using a subtraction value of the respectively corresponding input signals $x_1$ to $x_N$ multiplied by the constant C from each present parameter $\omega_1$ to $\omega_N$ inputted from each multiplier 31 when the second AND circuit 42 outputs the high level signal H, i.e., when the air-fuel mixture determination signal from the comparator 35 indicates the rich side air-fuel mixture ratio in spite of the indication of lean side air-fuel mixture ratio of the output signal derived from the teaching circuit 12. In addition, the constant $x_{N+1}$ in the memory 32M is corrected and updated by subtraction of the constant C.

It is noted that the multipliers 31 and memory 32M store parameters corresponding to the two kinds of weight vectors $\omega_{11}$ and $\omega_{22}$ for the abrupt acceleration/deceleration and for the steady-state operating condition. The weight vector switching circuit 16 changes the corresponding parameters according to the weight vectors $\omega_{11}$ and $\omega_{22}$ during the correction and updating of the parameters and during the rich-or-lean air-fuel mixture ratio determination during the running of the vehicle.

It is noted that values of parameters of the weight vector set by means of the linear classifier 9 are not correct at the initial stage of learning thereof and therefore a percentage of correct answers of the rich-or-lean air-fuel mixture ratio is very low.

At this time, the efficiency of learning is reduced if the weight vector is switched by means of the weight vector switching circuit 16. Therefore, the correct answer percentage is calculated and only the weight vector for the steady-state condition is used until the percentage exceeds a certain value.

Next, the forming of the rich-or-lean determination signal in the linear classifier 9 and method for correcting and learning the parameters of the weight vector on the basis of the signal derived from the teaching circuit 12 will be described below.

A general operation theory of a binary determining type linear classifier using a thresold value logic operator will be described below.

Figure 5:
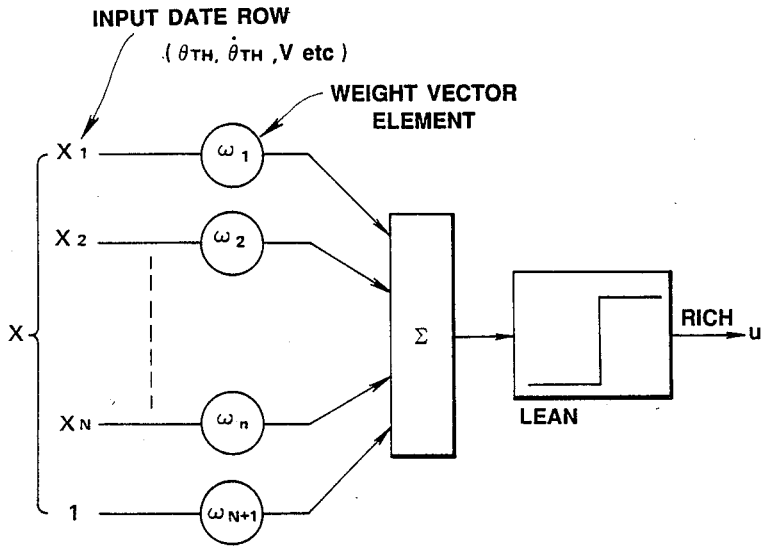
FIG. 5 is a schematic block diagram for explaining an operation of the linear classifier shown in FIG. 3.

As shown in FIG. 5, two categories can be divided according to certain linear equations on the basis of the combinations of an input row $x_i$ (i=1, 2, ---, N).

For example, the equation $y=5x_1-2x_2$ is employed as a linear equation.

If the value of y is positive, it is deemed as the rich side air-fuel mixture ratio (the determination of category A is made). If the value of x is negative, it is deemed as the lean side air-fuel mixture ratio (the determination of category B is made).

At this time, if $x_1=5$ and $x_2=-4$, then y=33 and therefore y is positive (if the input row $(x_1, x_2)=(5, -4)$, then y=33 from the equation and therefore the input row (5, −4)) and is determined to be in the category A (deemed as the rich side air-fuel mixture ratio).

Suppose that the coefficient to the input in the equation is indefinite. Since the coefficient is indefinite, the coefficient is arbitarily determined so that the value of y is calculated first. The determination of category A or B (rich or lean air fuel mixture) is made according to the value of y derived from the arbitary coefficient. It is therefore natural that there will be cases where the correct determination is carried out and where the incorrect determination is carried out.

At this time, this system can check whether its determination is correct or incorrect. Even if one of the factors is determined arbitrarily initially through subsequent trial and error operations a precise value can be obtained. Therefore, the indefinite coefficient is determined through the learning from the taught determination of correctness and incorrectness and input row.

The above-described learning process is applied to the preferred embodiment.

The input row $x_i$ corresponds to the opening angle $_{TH}$, the first order difference of the throttle valve opening angle $\dot{\theta}_{TH}$, vehicle speed V, the first-order difference A of the vehicle speed, and the running resistance D.

In addition, the weight vector parameters $\omega_1$, $\omega_2$, $\omega_3$---, $\omega_N$ are parameters (weights) corresponding to the various types of input information $x_1$, $x_2$, $x_3$, ---$x_N$.

Let now us assume that the parameter group of the equation at the number of determination times k is denoted by $\omega_{ik}$. That is to say, the equation is expressed as $y_k=\omega_{1k}x_1+\omega_{2k}x_1+---+\omega_{Nk}x_N$.

This value is derived by the adder 33 and is compared with the reference value δ for determining the rich-or-lean air-fuel mixture ratio inputted to the comparator 35. If $y_k>\delta$, it is deemed as the rich side air-fuel mixture ratio. If $y_k<\delta$, it is deemed as the lean-side air-fuel mixture ratio.

The result described above is compared with the teaching signal derived from the teaching circuit 12 by means of the Exclusive-OR circuit 37. If both signals coincide with each other, i.e., the determination of the rich or lean air-fuel mixture ratio is correct, each value of $\omega_{ik}$ is not changed. That is to say, the weight vector corrector 32 is not activated and the correction of the weight vector is not carried out.

On the other hand, although when $y_k<\delta$, it is deemed as the lean air-fuel mixture if the teaching signal indicates the rich air-fuel mixture ratio. At this time, it is deemed that the determination of the lean air-fuel mixture ratio is erroneous. If the air-fuel mixture ratio control is carried out on the basis of the erroneous determination, the inverse control of the rich or lean mixture control is processed so that the peak value of the internal cylinder pressure is abruptly reduced, the engine torque is abruptly reduced, and engine knocking occurs.

To prevent such an erroneous determination of the air-fuel mixture, the weight vector is learned and corrected as follows.

That is to say, although the lean mixture is determined since $y_k<\delta$, the teaching signal indicates the rich air-fuel mixture ratio so that the erroneous determination of the lean mixture ratio results.

At this time, $\omega_{K+1}=\omega_K+Cx'_K$.

In the above-expressed equation. $x'_K$ denotes a matrix element N+1 in which 1 is added to the last item of the input row vectors $x_i$. C denotes an arbitrary positive number governing a convergence state of learning.

Since, in this case, each parameter $\omega_i$ is incremented by $Cx_i$, the value of $y_K$ is incremented so that the value of $y_K$ under the same condition is increased so as to correct the weight vector in a direction in which the correct determination results of the rich air-fuel mixture ratio can be increased.

Since each parameter $\omega_i$ is incremented by a value proportional to the input detection value $x_i$, the correction quantity of the parameters $\omega$ under the operating condition in which the degree associated with the enriched air-fuel mixture is large and the correction quantity of the parameters under the engine operating condition in which the degree associated with the enriched air-fuel mixture is small. Hence, the parameter correction is carried out in a direction in which the percentage of correct answers becomes increased for each parameter.

In addition, although $y_K < \delta$ and the rich air-fuel mixture ratio determination is carried out, the teaching signal indicates the lean air-fuel mixture ratio. At this time, the rich air-fuel mixture ratio determination is erroneous.

At this time, $\omega_{K+1} = \omega_K - Cx'_k$.

In this case, hence, the correction quantity of the parameters under the operating condition in which the degree associated with the lean air-fuel mixture ratio is large is increased. The correction quantity of the parameters is carried out in a direction toward which the percentage of correct answers of the lean air-fuel mixture ratio is increased for each parameter.

As the correction and learning are repeated, the percentages of the correct answers of rich or lean air-fuel mixture ratio increase so as to approach the best values of the parameter at which the favorable determination results can be achieved.

Figure 6:
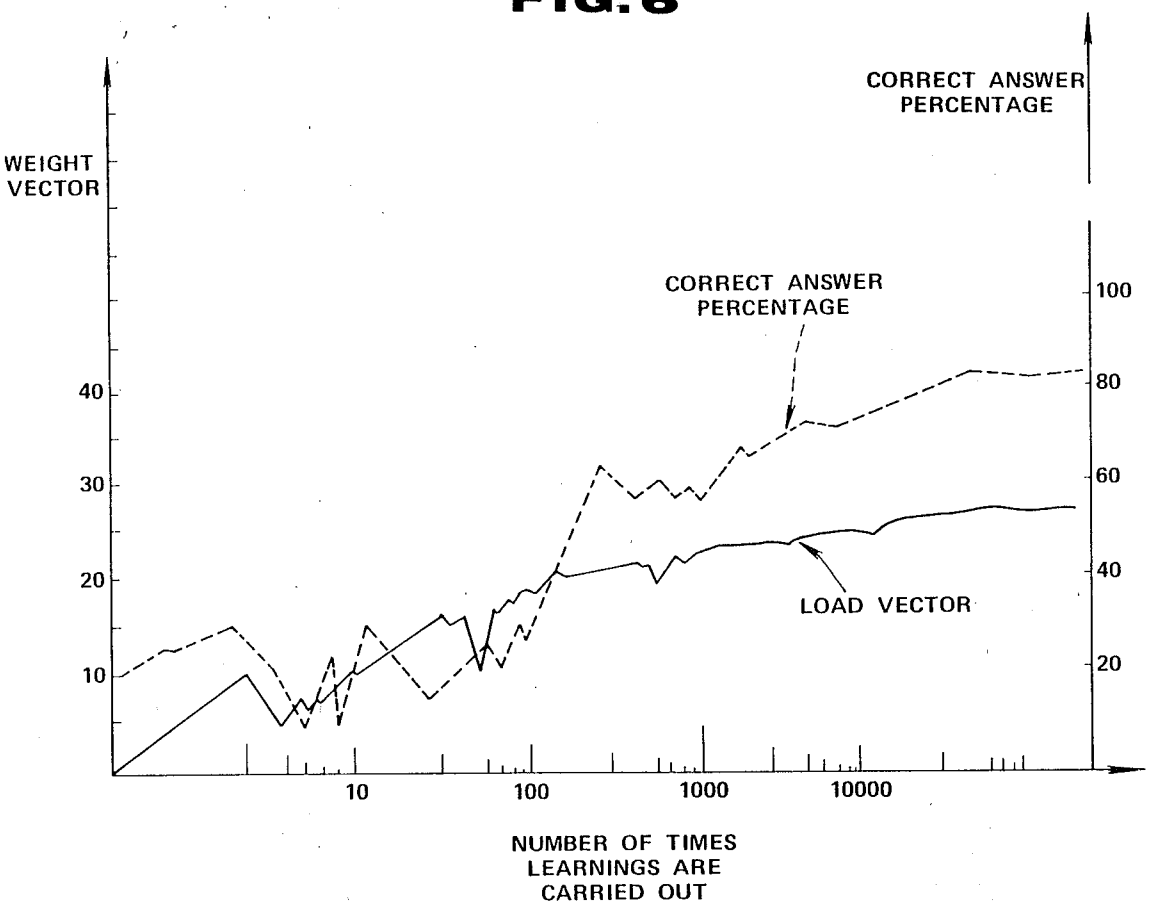
FIG. 6 is a characteristic graph showing a weight vector and correct answer percentage of the air-fuel mixture ratio with respect to the number of times the weight vectors are corrected.

FIG. 6 shows a relationship between the number of times the learning is carried out and both the weight vector value and correct answer percentage.

As shown in FIG. 6, as the number of times the learning is carried out, the correct answer percentage is increased. In this way, when the correct answer percentage exceeds a predetermined value, the learning is ended and a programming of an on-board air-fuel mixture ratio controlling system is completed with the teaching circuit removed. In this case, since the $O_2$ sensor and so on are not needed in the vehicle during the shipment, a lower cost engine can be achieved.

Especially, in the preferred embodiment, the vehicle operating conditions to be considered for the determination of rich or lean air-fuel mixture ratio include the throttle opening angle, vehicle speed, and their first-order differences, and running resistance. Since these operating condition parameters largely affect the air-fuel mixture ratio change and the degrees of their contribution to the change in the air-fuel mixture are different, the accuracy of air-fuel mixture determination can be enhanced for every type of operating conditions. Hence, the accuracy of air-fuel mixture ratio determinations can greatly be improved with an inexpensive construction, the expensive intake air quantity detecting means is not needed, and the low-cost internal cylinder pressure sensor is used so that a sufficiently high accurate air-fuel mixture ratio controlling system can be achieved.

In addition, if the parameters derived as the result of learning of the weight vector are observed, the condition of the engine can be grasped to some degree. For example, if a blow-up (engine acceleration of a revolution speed) is worsened, its property can be recognized by an abnormal change of the parameters with respect to $\theta_{TH}$ (throttle valve opening angle) and A (first order difference of the vehicle speed) when comparing the other same series engine.

As described hereinabove, since, in the system and method for controlling an air-fuel mixture ratio supplied to the engine according to the present invention, the air-fuel mixture ratio can be determined with high accuracy and can be controlled using internal cylinder pressure detecting means in place of the expensive intake air quantity detecting means. The reduced cost of the whole engine can be achieved. In addition, the property inherent to the used engine can be grasped through the observation of the weight vector.

It will fully be appreciated by those skilled in the art that the foregoing description is made in terms of the preferred embodiment and various changes and modifications may be made without departing from the scope of the present invention which is to be defined by the appended claims.

What is claimed is:

1. A system for determining and controlling the mixture ratio of an air-fuel mixture supplied to an internal combustion engine, comprising:

(a) first means for detecting an internal pressure of an engine cylinder;

(b) second means for deriving a maximum value of the internal cylinder pressure detected by the first means for each combustion stroke of the engine cylinder and for estimating the rich-side air-fuel mixture ratio and lean-side air-fuel mixture ratio from the derived maximum value of the internal cylinder pressure;

(c) third means for detecting various operating conditions of the engine and a vehicle in which the engine is mounted affecting a change in the air-fuel mixture ratio except the first means and outputting first signals indicative of the individual operating conditions;

(d) fourth means for processing a weighting calculation for the first signals using a weight vector and outputting a second signal indicative of the result of the weighting calculation, the second signal being used to determine the rich or lean air-fuel mixture ratio;

(e) fifth means for comparing the level of the second signal with a reference signal level so as to determine whether the air-fuel mixture ratio deviates from the rich-side or lean-side with respect to a target air-fuel mixture ratio;

(f) sixth means for ascertaining the air-fuel mixture ratio from the rich-side or lean-side air fuel mixture ratio estimated by the second means on the basis of the determination result by the fifth means;

(g) seventh means for controlling the mixture ratio of air-fuel fuel mixture supplied to the engine on the basis of the air-fuel mixture ratio ascertained by the sixth means;

(h) eighth means for determining the correctness or incorrectness of the determination result by the fifth means according to the air-fuel mixture controlled by the seventh means; and (i) ninth means for correcting the weight vector in the fourth means on the basis of the result of determination by the seventh means in a direction toward which a percentage of the correct determination is increased.

2. The system as set forth in claim 1, wherein the third means includes a vehicle speed sensor for detecting a vehicle speed of the vehicle, tenth means for calculating a first-order difference of the vehicle speed, a throttle valve opening angle sensor for detecting an opening angle of the throttle valve, eleventh means for calculating a first-order difference of the throttle valve opening angle, twelfth means for calculating a running resistance of the vehicle on the basis of the vehicle speed and the throttle valve opening angle.

3. The system as set forth in claim 2, which further comprises thirteenth means for selecting the weight vector depending on at least one of the vehicle and engine operating conditions.

4. The system as set forth in claim 3, wherein the thirteenth means selects the weight vector in the fourth means depending on whether there occurs an abrupt engine acceleration/deceleration state or a steady state.

5. The system as set forth in claim 4, wherein the thirteenth means selects the weight vector in the case of the steady state when the correct percentage of the determination result of the seventh means is below a first predetermined percentage.

6. The system as set forth in claim 1, wherein the sixth means comprises a selector which selects either the rich-side air-fuel mixture ratio or lean-side air-fuel mixture ratio depending on the result of determination by the fifth means.

7. The system as set forth in claim 6, wherein the second means includes a map table representing a characteristic graph of the maximum value of the internal cylinder pressure versus the air-fuel mixture ratio.

8. The system as set forth in claim 1, wherein the eighth means is removed from the system when the percentage of the correct determination by the fifth means is increased and exceeds a second predetermined percentage of the correct determination.

9. The system as set forth in claim 8, wherein the eighth means includes an $O_2$ sensor for detecting a concentration of oxygen in an exhaust gas of the engine.

10. The system as set forth in claim 1, wherein the fourth means comprises a linear classifier having a plurality of multipliers for multiplying parameters $\omega_1$ to $\omega_N$ of the weight vector respectively corresponding input first signals $x_1$ to $x_N$ derived from the third means and an adder for receiving and adding each value of the multipliers indicative of the first signal derived by the third means multiplied by the corresponding parameter of the weight vector.

11. The system as set forth in claim 10, wherein the adder outputs an end signal upon the end of calculation of adding and outputs a synthronization signal to eighth means, whereby the eighth means outputs a correctness or incorrectness determination signal to the ninth means in response to the synchronization signal.

12. The system as set forth in claim 1, wherein the ninth means corrects the weight vector when the eighth means determines that either rich-side air fuel mixture or lean-side air-fuel mixture is incorrect.

13. The system as set forth in claim 12, wherein the ninth means corrects each weight vector parameter in the direction such that each value of the parameters of the weight vector is increased when the eighth means determines that the rich-side air-fuel mixture ratio is correct although the fifth means determines the lean-side air-fuel mixture ratio.

14. The system as set forth in claim 12, wherein the ninth means corrects each weight vector parameter in the direction such that each value of the parameters of the weight vector is decreased when the eighth means determines that the lean-side air-fuel mixture ratio is correct although the fifth means determines the rich-side air-fuel mixture ratio.

15. The system as set forth in claim 13, wherein the ninth means corrects each weight vector parameter in accordance with such a formula as $\omega_{K+1}=\omega_K+C\times X'_{K'}$, wherein C denotes an arbitrary positive number and $X'_K$ denotes a vector parameter of (N+1) element of an input first signal row vector constituted by the first signals derived by the third means to which 1 is added.

16. The system as set forth in claim 14, wherein the ninth means corrects each weight vector parameter in accordance with such a formula as $\omega_{K+1}=\omega_K-C\times X'_{K'}$, wherein C denotes an arbitrary positive number and $X'_K$ denotes a vector of (N+1) element of an input signal row vector constituted by the first signals derived by the third means to which 1 is added.

17. The system as set forth in claim 1, wherein the target air-fuel mixture is a stoichiometric air-fuel mixture ratio.

18. A method for determining and controlling a mixture ratio of air-fuel mixture supplied to an internal combustion engine, comprising the steps of:

(a) detecting an internal pressure of an engine cylinder;

(b) second means for deriving a maximum value of the internal cylinder pressure detected in the step (a) for each combustion stroke of the engine cylinder and estimating rich-side air-fuel mixture ratio and lean-side air-fuel mixture ratio from the derived maximum value of the internal cylinder pressure;

(c) detecting various operating conditions of the engine and a vehicle in which the engine is mounted affecting a change in the air-fuel mixture ratio except that detected in the step (a) and outputting the first signals indicative of the individual operating conditions;

(d) calculating a weighting processing for the first signals using a weight vector and outputting a second signal indicative of the result of the weighting processing calculation, the second signal being used to determine the rich or lean side air-fuel mixture ratio;

(e) comparing the level of the second signal with a reference signal level so as to determine whether the air-fuel mixture ratio is deviates from the rich-side or lean-side with respect to a target fuel mixture ratio;

(f) ascertaining the air-fuel mixture ratio from either the rich-side or lean-side air-fuel mixture ratio estimated in the step (b) on the basis of the determination result in step (e);

(g) controlling the mixture ratio of air-fuel mixture supplied to the engine on the basis of the mixture ratio ascertained in step (f);

(h) determining a correctness or incorrectness of the determination result of step (e) according to the air-fuel mixture ratio controlled in step (g); and (i) correcting the weight vector used in step (d) on the basis of result of determination in the step (h) in a direction toward which a percentage of the correct determination in step (e) is increased.

* * * * *